US011933588B2

(12) United States Patent
Stenzel et al.

(10) Patent No.: US 11,933,588 B2
(45) Date of Patent: Mar. 19, 2024

(54) PROJECTILE, IN PARTICULAR IN THE MEDIUM CALIBER RANGE

(71) Applicant: RHEINMETALL WAFFE MUNITION GMBH, Suedheide (DE)

(72) Inventors: Udo Stenzel, Bad Bocklet (DE); Tobias Litte, Hirrlingen (DE); Daniel Stopper, Rottenburg-Ergenzingen (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 94 days.

(21) Appl. No.: 17/752,521

(22) Filed: May 24, 2022

(65) Prior Publication Data

US 2023/0055141 A1 Feb. 23, 2023

Related U.S. Application Data

(60) Division of application No. 16/581,825, filed on Sep. 25, 2019, now Pat. No. 11,371,815, which is a continuation of application No. PCT/EP2018/055752, filed on Mar. 8, 2018.

(30) Foreign Application Priority Data

Mar. 27, 2017 (DE) ..... 10 2017 106 526.1

(51) Int. Cl.
*F42B 12/06* (2006.01)
*F42B 12/34* (2006.01)
*F42B 12/36* (2006.01)

(52) U.S. Cl.
CPC ..... *F42B 12/06* (2013.01); *F42B 12/34* (2013.01); *F42B 12/367* (2013.01)

(58) Field of Classification Search
CPC ..... F42B 12/06; F42B 12/34; F42B 12/36; F42B 12/367
USPC ..... 102/507, 510, 518
See application file for complete search history.

(56) References Cited

U.S. PATENT DOCUMENTS

| | | | |
|---|---|---|---|
| 2,322,751 | A | 6/1943 | Studler |
| 3,780,658 | A | 12/1973 | de Longueville et al. |
| 3,782,287 | A | 1/1974 | Sie |
| 3,795,196 | A | 3/1974 | Hillenbrand |
| 4,108,072 | A | 8/1978 | Trinks et al. |
| 4,353,302 | A | 10/1982 | Strandli et al. |
| 4,353,305 | A | 10/1982 | Moreau et al. |
| 4,444,112 | A | 4/1984 | Strandli et al. |

(Continued)

FOREIGN PATENT DOCUMENTS

| | | | |
|---|---|---|---|
| CH | 351522 | A | 1/1961 |
| DE | 1428679 | C1 | 9/1977 |

(Continued)

OTHER PUBLICATIONS

Machine translation of EP-3514479-A1 (Year: 2019).*

(Continued)

*Primary Examiner* — James S Bergin
(74) *Attorney, Agent, or Firm* — Muncy, Geissler, Olds & Lowe, P.C.

(57) ABSTRACT

A projectile having a projectile body for holding a penetrator, a projectile rear, and a projectile ogive. The projectile body has a narrowed point, on which the penetrator can be supported. The narrowed point results in reliable breaking open of the projectile body when the projectile hits a target.

5 Claims, 1 Drawing Sheet

(56) References Cited

U.S. PATENT DOCUMENTS

| | | | | |
|---|---|---|---|---|
| 5,160,805 | A | 11/1992 | Winter | |
| 5,442,989 | A | 8/1995 | Anderson | |
| 5,794,320 | A | 8/1998 | Wernz et al. | |
| 6,659,013 | B1 | 12/2003 | Kellner | |
| 6,772,695 | B2 | 8/2004 | Kellner | |
| 6,772,696 | B2 | 8/2004 | Kellner | |
| 6,789,484 | B2 | 9/2004 | Kellner | |
| 7,520,224 | B2 | 4/2009 | Taylor | |
| 8,074,574 | B2 | 12/2011 | Riess et al. | |
| 10,082,376 | B1 | 9/2018 | Thomas et al. | |
| 10,393,487 | B2 | 8/2019 | Riess | |
| 10,942,014 | B2 | 3/2021 | Stenzel et al. | |
| 10,976,143 | B2 * | 4/2021 | Muster | F42B 12/207 |
| 11,371,815 | B2 * | 6/2022 | Stenzel | F42B 12/34 |
| 2004/0069176 | A1 | 4/2004 | Kellner | |
| 2007/0006766 | A1 | 1/2007 | Kellner | |
| 2010/0224093 | A1 | 9/2010 | Wilhelm et al. | |

FOREIGN PATENT DOCUMENTS

| | | | | |
|---|---|---|---|---|
| DE | 2727970 | A1 | 1/1978 | |
| DE | 8137891 | U1 | 5/1985 | |
| DE | 4024543 | A1 | 2/1992 | |
| DE | 19604061 | A1 | 8/1997 | |
| DE | 19700349 | C1 | 8/1998 | |
| DE | 29817416 | U1 | 1/1999 | |
| DE | 10 2004 005 042 | A1 | 9/2005 | |
| DE | 10 2004 036 148 | A1 | 2/2006 | |
| DE | 10 2006 025 330 | A1 | 12/2007 | |
| DE | 10 2011 011 478 | A1 | 8/2012 | |
| EP | 2 551 630 | A2 | 1/2013 | |
| EP | 3514479 | A1 * | 7/2019 | F42B 12/06 |
| FR | 764833 | A | 5/1934 | |
| GB | 831405 | A | 3/1960 | |
| GB | 1 605 020 | | 12/1981 | |
| WO | WO 2004/003460 | A1 | 1/2004 | |

OTHER PUBLICATIONS

International Search Report dated May 29, 2018 in corresponding application PCT/EP2018/055752.

Written Opinion of the International Searching Authority for International Application No. PCT/EP2018/055752 dated Oct. 4, 2018.

* cited by examiner

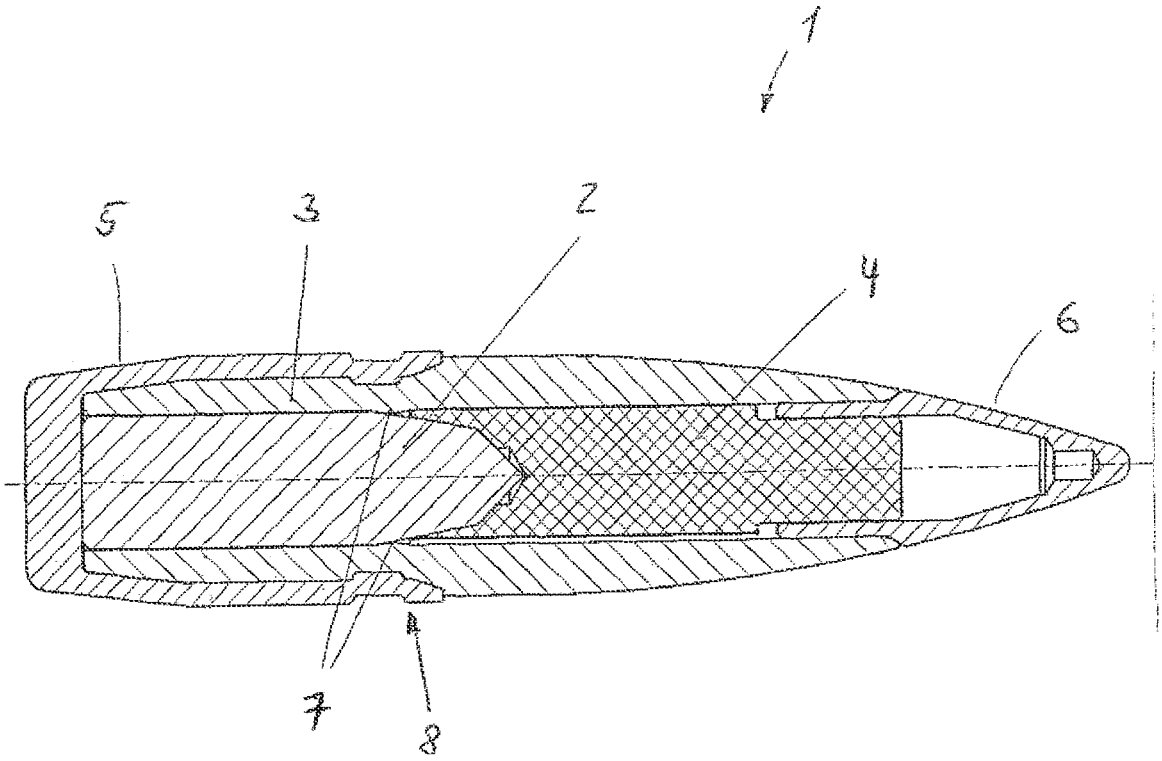
1
5
3
2
4
6
7
8

PROJECTILE, IN PARTICULAR IN THE MEDIUM CALIBER RANGE

This nonprovisional application is a division of U.S. application Ser. No. 16/581,825 filed on Sep. 25, 2019, which is a continuation of International Application No. PCT/EP2018/055752, which was filed on Mar. 8, 2018, and which claims priority to German Patent Application No. 10 2017 106 526.1, which was filed in Germany on Mar. 27, 2017, and which are all herein incorporated by reference.

BACKGROUND OF THE INVENTION

Field of the Invention

The present invention relates to a projectile, in particular PELE® ammunition.

Description of the Background Art

The functional principle of PELE® ammunition, as known from DE 197 00 349 C2, which corresponds to US 2004/0129163, which is incorporated herein by reference, is based on the fact that materials with lower density than the highly effective terminal-ballistic penetration material (referred to below as the penetrator) at high projectile speeds remain in the target compared to the highly effective terminal ballistic penetrator. The enclosed expansion medium breaks the projectile body open under compression on the impact of the projectile and leads to splinter formation.

DE 10 2004 005 042 B4 discloses a universal KE projectile. This differs from known projectiles of this type in that an outer penetrator is mounted around a central penetrator, the outer penetrator contains spherical and/or cylindrical ductile heavy metals and is implemented in an arched shape. The same design can be seen in the central penetrator.

DE 10 2011 011 478 A1 discloses a frangible projectile, especially for practice purposes. This is based on the ammunition known as PELE® ammunition, which is known from DE 197 00 349 C1. For this it will be stated that the construction of such frangible projectiles, especially in the medium-caliber range, places high demands on the production thereof. The segment parts and the core part must be inserted into the outer sleeve area. This must be done precisely in order not to disturb the flight characteristics. In addition, the individual parts must be joined to each other. Said joints are then subject to high demands, for example with regard to launch strength, connectivity to the expansion medium, etc. The basic idea is therefore to make the projectile in one piece. In this case the impact affects the whole projectile. The projectile has recesses for an expansion medium distributed over the cross-section.

Such projectiles are launched from barreled weapons with a spin to stabilize the projectile position on the trajectory. The very high rotation rate imparted by the spin of the projectile also places high demands on the roundness of the projectile body and the penetrator in order to achieve the desired hit accuracy.

SUMMARY OF THE INVENTION

It is therefore an object of the present invention to provide a projectile with a high hit accuracy. Another aspect is to reduce the effort required to produce this projectile.

In an exemplary embodiment, a projectile body is advantageously formed as a tube section from very brittle, hardened material. In its rear part there is a penetrator. This compresses an expansion medium on hitting a target. This leads to the break-up of the body of the projectile. Due to the brittleness of the material of the projectile body, the desired splinter formation is achieved. The projectile body, together with a projectile rear, guides the penetrator during the passage thereof through the barrel during firing and during the flight to the target.

This roundness cannot be achieved by simply cutting a long barrel into suitable barrel sections, as the barrel sections warp during the hardening process. However, on the one hand warped sections of barrel lead to poor hit accuracy. On the other hand, completion with a very precisely manufactured penetrator can lead to fractures of the body during production. The consequence may be an increased rejection rate. But also during launch there can be fractures of the projectile, i.e. in the weapon or shortly after leaving the muzzle, which then leads to the premature disintegration of the projectile. The required roundness of the body is therefore usually achieved by reworking, such as fine turning or cylindrical grinding, of the inner and outer diameters. This reworking is carried out outside and inside over the full length of the section of barrel that is produced oversize.

However, the invention is based on the idea of not reworking the body to the required roundness inside and out over its entire length, but on carrying out the reworking of the inner diameter for the accommodation of the penetrator from one side or from both sides at a distance from the center of the body of the projectile. This obtains a constriction remaining in the region of the middle of the barrel section.

The constriction has the advantage that, for example, the penetrator can be set against said constriction during the production of the penetrator instead of resting against the softer expansion medium. Also, it is achieved that when the object is hit, when the body is decelerated, the penetrator safely breaks said projectile body open at the constriction due to its inertia. This safe breakup leads to the desired splinter formation of the body. In addition, due to the longitudinal fixing of the penetrator, oscillation of the penetrator inside the projectile or the body of the projectile is prevented, which leads to improved precision of the projectile.

Another advantage of a projectile body designed in this way is the relative independence from the mechanical properties of the expansion medium. In addition, all materials and material forms already shown in DE 197 00 349 C1 can be used. In a special version, an expansion medium can also be dispensed with.

The aforementioned versions are adaptable for a projectile in the caliber range of 12 to 76 mm, in particular 12.7 mm.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein the sole FIGURE illustrates a projectile according to an exemplary embodiment of the invention.

DETAILED DESCRIPTION

The single FIGURE shows a projectile 1 (frangible projectile) with a penetrator 2 encased in a projectile body 3. An expansion medium 4 is inserted in front of the penetrator in the projectile body 3. The projectile body 3 is completed by a projectile stern 5 on the rear side. The body 3 has a projectile ogive 6 on the front side. The projectile ogive 6 can preferably be joined to the projectile body 3 by means of a screw connection.

The special feature of the projectile 1 is that a constriction 7 for the penetrator 2 is introduced into the projectile body 3 (or a protrusion when viewed from the perspective of the inner diameter of the projectile body 3), on which the penetrator 2 can be supported within the projectile body 3. The constriction 7 is preferably provided in the central region 8 of the projectile body 3. The constriction 7 can also be present circumferentially in the projectile body 3. However, partial solutions are not excluded.

With the impact of the projectile 1 on an unspecified target, the projectile body 3 is decelerated. The penetrator 2, on the other hand, is moved further due to inertia, compressing the softer expansion medium 4. At the same time, the projectile body 3 breaks open at the constriction 7, resulting in a safe and desired splinter formation by the projectile body 3. If this force is sufficient, in special cases an expansion medium 4 can be dispensed with.

An alternative to the constriction in the middle region 8 of the projectile body 3 forms an off-center constriction. The principle of operation is the same as described.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A projectile comprising:

a penetrator;

a projectile body for accommodating the penetrator, the projectile body being a tube section with an inner diameter having a constriction configured for supporting the penetrator;

a projectile stern; and a projectile ogive, wherein the inner diameter of the projectile body is processed from both front and rear sides of the projectile body, such that the inner diameter of the projectile body at the constriction is smaller than at all remaining portions of the inner diameter provided forward and rearward of the constriction, and wherein, with respect to an axial direction of the inner diameter, a length of the constriction is smaller than a length of each of the remaining portions of the inner diameter provided forward and rearward of the constriction.

2. The projectile as claimed in claim 1, wherein the constriction is provided in a central region of the projectile body.

3. The projectile as claimed in claim 1, wherein an expansion medium is incorporated.

4. The projectile as claimed in claim 3, wherein the expansion medium is arranged in front of the penetrator in the projectile body.

5. The projectile as claimed in claim 1, wherein a front distal end and a rear distal end of the projectile body each have an opening, such that the projectile body has a continuous bore, having the inner diameter, that extends through an entire length of the projectile body, and wherein the opening at the rear distal end of the projectile body is closed by the projectile stern and the opening at the front distal end of the projectile body is closed by the projectile ogive.

* * * * *